US012312058B2

(12) United States Patent
Wood

(10) Patent No.: US 12,312,058 B2
(45) Date of Patent: May 27, 2025

(54) ELECTRICALLY-OPERATED JACK PLATE WITH REMOTE CONTROL FEATURE

(71) Applicant: John Martin Wood, Tallahassee, FL (US)

(72) Inventor: John Martin Wood, Tallahassee, FL (US)

( * ) Notice: Subject to any disclaimer, the term of this patent is extended or adjusted under 35 U.S.C. 154(b) by 600 days.

(21) Appl. No.: 17/571,815

(22) Filed: Jan. 10, 2022

(65) Prior Publication Data

US 2023/0219670 A1 Jul. 13, 2023

(51) Int. Cl.
*B63H 20/10* (2006.01)
*B63H 20/06* (2006.01)
*B63H 21/21* (2006.01)

(52) U.S. Cl.
CPC ..... *B63H 20/106* (2013.01); *B63H 20/06* (2013.01); *B63H 21/21* (2013.01); *B63H 2021/216* (2013.01)

(58) Field of Classification Search
CPC ..... B63H 20/06; B63H 20/106; B63H 21/21; B63H 2021/216
USPC ..... 440/53, 61, 61 R
See application file for complete search history.

(56) References Cited

U.S. PATENT DOCUMENTS

| | | | | |
|---|---|---|---|---|
| 8,267,025 | B2 * | 9/2012 | Witte | B63H 20/106 248/641 |
| 8,535,105 | B1 * | 9/2013 | Pelini | B63H 20/02 440/61 E |
| 9,598,159 | B2 * | 3/2017 | Nyren | B63H 20/06 |
| 10,343,756 | B2 * | 7/2019 | Vance, Jr. | B63H 20/106 |
| 11,046,407 | B2 * | 6/2021 | Van Dyke | B63H 20/06 |

* cited by examiner

*Primary Examiner* — Daniel V Venne
(74) *Attorney, Agent, or Firm* — J. Wiley Horton

(57) ABSTRACT

A vertically adjustable jack plate configured to attach an outboard motor (or analogous device) to the transom of a marine vessel. A transom bracket is provided for connection to the vessel. A motor mounting plate is connected to the transom bracket. An electrical lift jack vertically adjusts the position of the motor mounting plate with respect to the transom bracket. The electrical lift jack is powered by a rechargeable battery that is preferably attached and detached from a controller housing. A separate remote control is provided to control the operation of the jack plate.

20 Claims, 7 Drawing Sheets

ELECTRICALLY-OPERATED JACK PLATE WITH REMOTE CONTROL FEATURE

BACKGROUND OF THE INVENTION

1. Field of the Invention

This invention relates to the field of marine vessels. More specifically, the invention comprises an electrically-operated jack plate configured to vary the height of an outboard motor or similar device with respect to a vessel transom.

2. Description of the Related Art

Outboard motors, trolling motors, and other accessories are frequently mounted to the transom of a marine vessel. As an example, outboard motors customarily include a pair of mounting clamps that slip over an upper lip of a transom and secure the motor in place. Many outboard motors include a tilting mechanism that pivots the entire motor about a horizontal axis. This tilting mechanism is used to adjust the depth of the motor's propeller in the water. Tilting the motor raises the propeller and allows the vessel to travel in more shallow water. Unfortunately, tilting the motor also inclines the propeller's rotation axis and produces an increasing downward component of the forward thrust. This downward component tends to reduce the efficiency of the outboard motor, as well as reducing its ability to steer the vessel.

The use of a "jack plate" is a well-known solution to these recognized problems. A jack plate is attached to the transom. It provides a vertical offset for the position of the outboard motor without the requirement of tilting the motor. Some jack plates are fixed, while others are adjustable. The prior art adjustable units can be moved by a user-powered mechanism, an electric drive motor, or a hydraulic actuator. Some of these can only be adjusted when the outboard motor is not operating and a position locking mechanism is released. Some can be adjusted while the outboard motor is in operation.

For the powered units, it is often cumbersome to provide a suitable electrical source and a connection thereto. A trolling motor battery is often used, with spring-loaded clips attaching the battery to the jack plate drive. The battery must be placed in the bottom of the boat and this can interfere with other operations. The activation of the prior art powered units is cumbersome as well since the user must divert his or her view to the vicinity of the jack plate while driving the boat. The present invention addresses these and other concerns.

BRIEF SUMMARY OF THE PRESENT INVENTION

The present invention comprises a vertically adjustable jack plate configured to attach an outboard motor (or analogous device) to the transom of a marine vessel. A transom bracket is provided for connection to the vessel. A motor mounting plate is connected to the transom bracket. An electrical lift jack vertically adjusts the position of the motor mounting plate with respect to the transom bracket. The electrical lift jack is powered by a rechargeable battery that is preferably attached and detached from a controller housing. A separate remote control is provided to control the operation of the jack plate.

REFERENCE NUMERALS IN THE DRAWINGS

Figure 1:
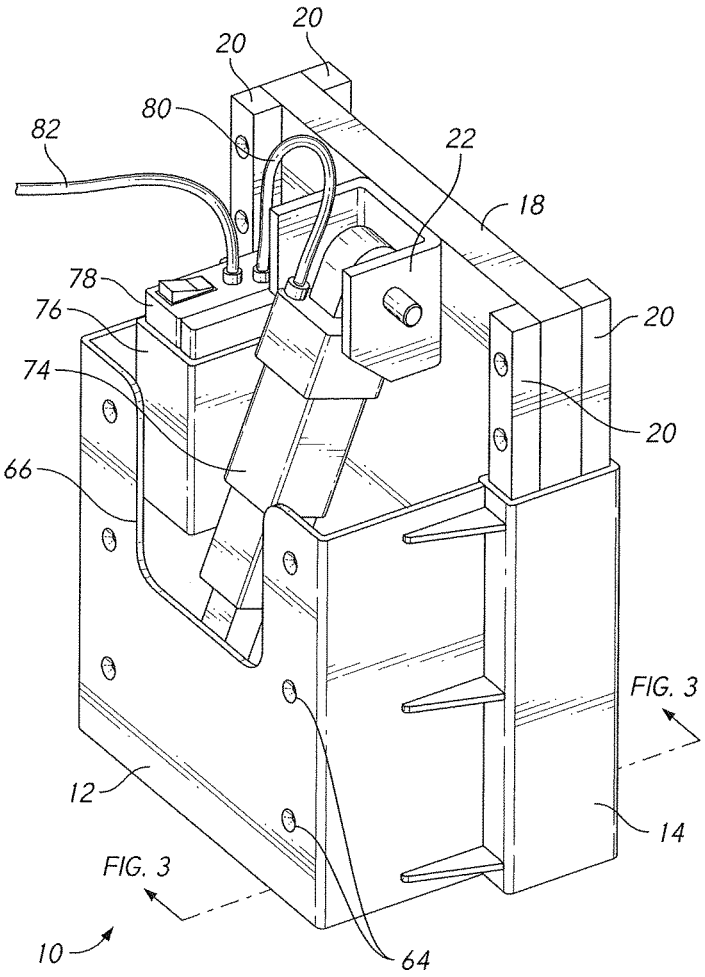
FIG. 1 is a perspective view, showing an embodiment of the proposed invention.

10 jack plate assembly
12 transom bracket
14 left receiver
15 slot
16 right receiver
18 motor mounting plate
20 slide rail
22 upper bracket
32 transom
34 clamp
36 outboard motor
38 upper pin joint
40 lower bracket
42 lower pin joint
44 extension leg
46 chassis
48 upper through hole
50 lower through hole
52 retaining ring
54 gear
56 gear
58 key
60 drive disk
62 spring
64 mounting hole
66 relief
74 electrical lift jack
76 receiver
78 controller housing
80 connector cord
82 external cord
84 motor housing
86 extension leg
88 motor
90 remote control
92 housing switch
94 remote switch
96 connector
98 connector
100 connector
102 battery
104 reversing relay assembly
106 controller
108 memory
110 communication module
112 I/O port
114 I/O port
116 antenna
118 antenna

120 battery
122 communication module
124 I/O port
126 I/O port
128 button
130 button
131 battery receiver
132 release
134 door

DETAILED DESCRIPTION OF THE INVENTION

The present invention can be physically realized in a wide variety of ways. FIGS. 1-7 illustrate exemplary embodiments of the invention. The reader should bear in mind, however, that the invention is not limited to any particular embodiment. Many more embodiment will occur to those skilled in the art following a review of this disclosure.

FIG. 1 shows a complete example of the invention labeled as jack plate assembly 10. Transom bracket 12 is configured to mount to the transom—such as by passing mounting bolts through mounting holes 64 and into the transom. Motor mounting plate 18 is slidably attached to transom bracket 12 so that it may be moved up and down as desired. This sliding attachment may be made using a variety of different components.

In the example shown in FIG. 1, a hollow receiver is provided on the left and right side of the transom bracket. Left receiver 14 is visible in the view. Right receiver 16 is a mirror image of left receiver 14, but is not visible in FIG. 1. The left side of motor mounting plate 18 slides up and down within left receiver 14 and the right side of motor mounting plate 18 slides up and down within right receiver 16.

Friction-reducing elements may be added to the interface between the motor mounting plate 18 and receivers 14,16. In the version shown, a pair of slide rails 20 are attached to each side of motor mounting plate 18. The actual method of attaching the slide rails to the mounting plate is not particularly important. One suitable approach is the use of cap screws passing through a counterbored hole and into the motor mounting plate.

Figure 7:
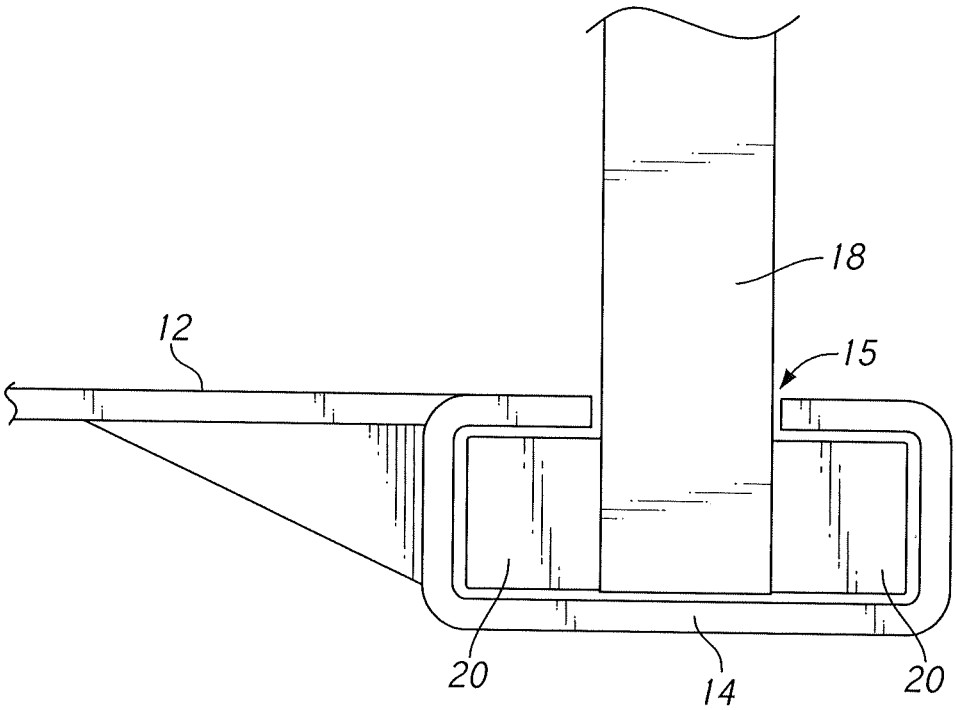
FIG. 7 is a detail view showing the interaction of the motor mounting plate and one of the receivers.

The slide rails are preferably made of a slick material such as NYLON (semi-aromatic polyamide) or DELRIN (polyoxymethylene). The addition of slide rails 20 gives the motor mounting plate an "I" cross section, with each end plate of the "I" cross section sliding up and down within a rectangular receiver 14, 16. FIG. 7 provides a detailed top view—looking down at the top of left receiver 14. The reader will note how the left side of motor mounting plate 18—along with its attached pair of slide rails 20—is a close sliding fit within the interior of left receiver 14. The reader will also note how slot 15 in left receiver 14 allows clearance for mounting plate 18. The interaction between motor mounting plate 18 and right receiver 16 is a mirror image of that shown in FIG. 7.

Returning to FIG. 1, the elevation of motor mounting plate 18 with respect to transom bracket 12 is regulated by the extension of electrical lift jack 74. Electrical lift jack 74 is attached at its lower end to transom bracket 12 and at its upper end to upper bracket 22 on motor mounting plate 18. Controller housing 78 is mounted in a convenient location (or may be free). In this example a removable receiver 76 is affixed to the inside of transom bracket 12 (in a position that leaves room for the motor mounting clamps). Receiver 76 is sized to slidably receiver controller housing 78. Connector cord 80 links the controller housing to electrical lift jack 74. A controller within the controller housing regulates the operation of the electrical lift jack in this embodiment. External cord 82 links the controller housing to optional external devices.

Relief 66 may be provided in the forward portion of transom bracket 12. A comparable relief is provided in the aft portion (not visible in FIG. 1). The relief in the aft portion provides clearance for the outboard motor mounting clamps.

Figure 2:
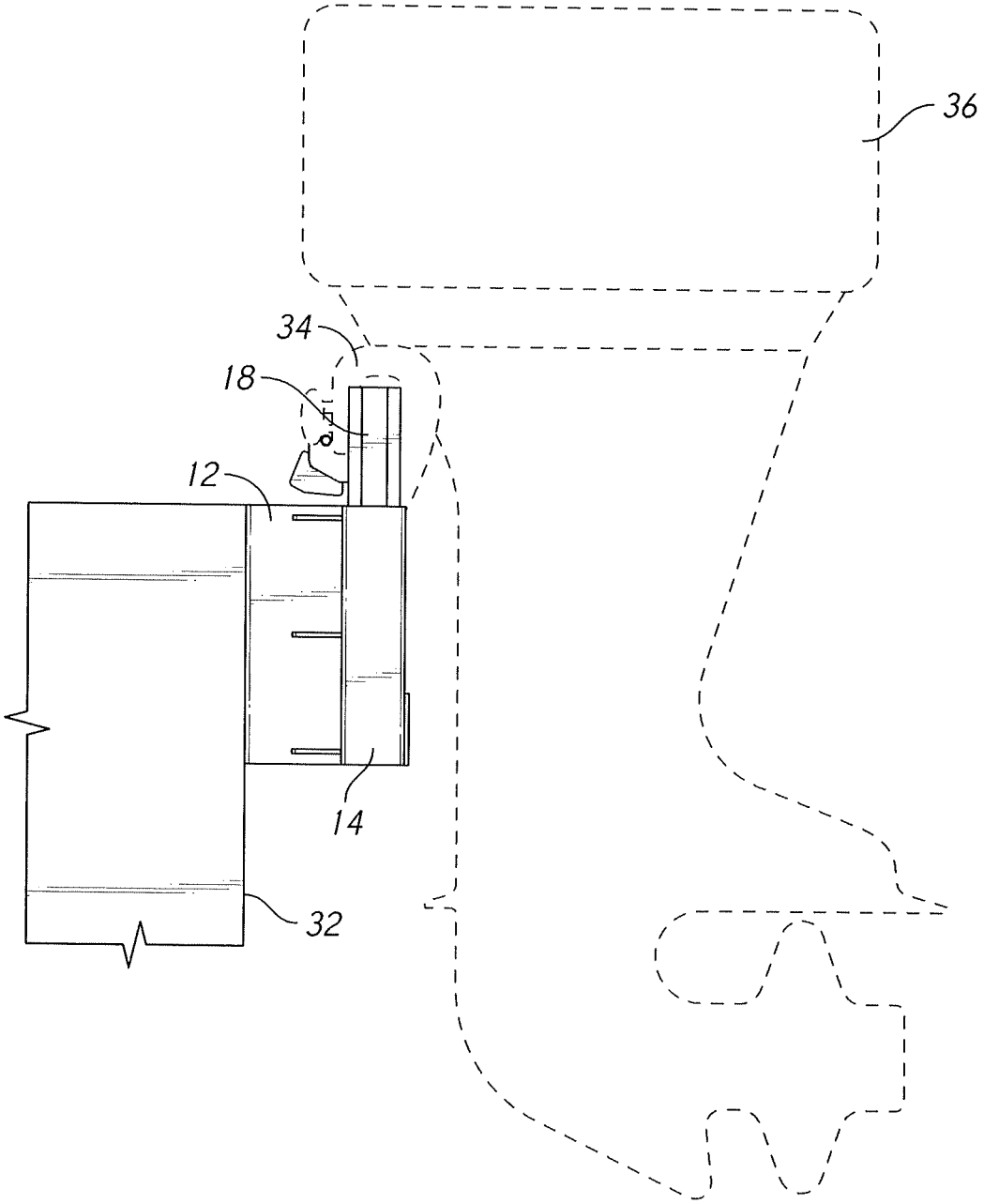
FIG. 2 is an elevation view, showing the proposed invention attached to a transom.

FIG. 2 depicts an elevation view of an exemplary installation of the present invention. Outboard motor 36 is attached to motor mounting plate 18 using a pair of clamps 34 that are usually integral to the outboard itself. These clamps are conventional in design and well known to those knowledgeable in the field. In this view the reader will observe that transom bracket 12 is attached to transom 32. The particular transom shown is vertical. Some transoms may tilt rearward so that the upper portion of the transom is further aft than the lower portion. The invention will work irrespective of the transom angle. Outboard motor 36 is fixedly attached to motor mounting plate 18. When the user raises and lowers the motor mounting plate 18, the outboard motor will move with it.

Figure 3:
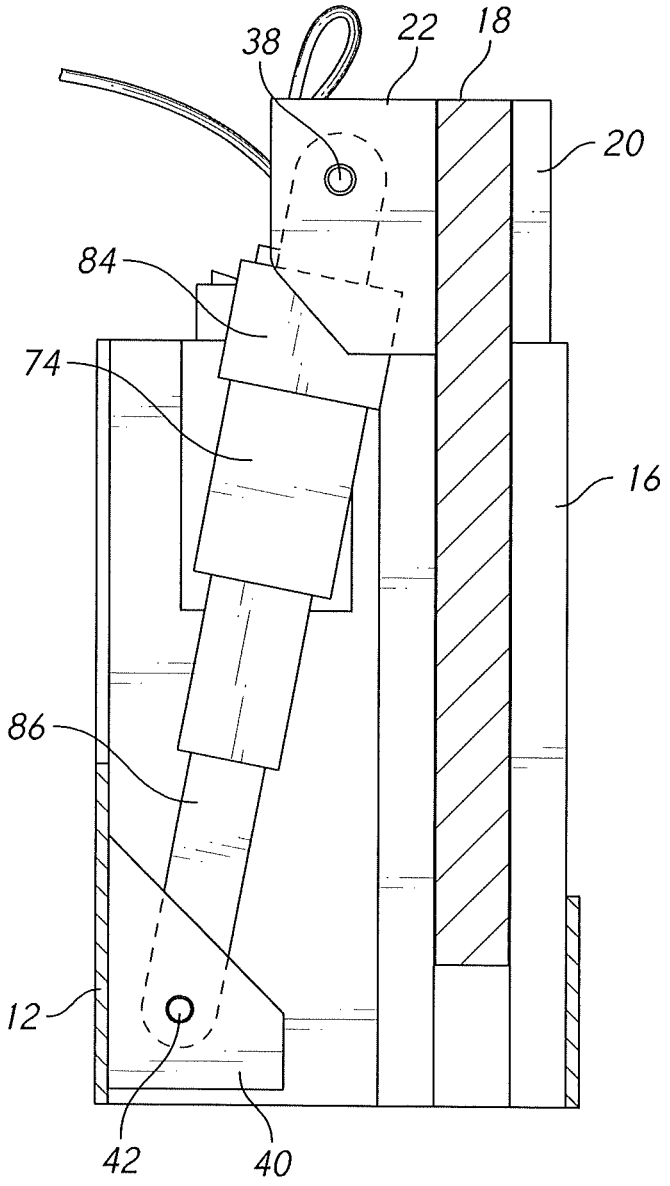
FIG. 3 is a sectional elevation view, showing some internal details of the proposed invention.

Returning briefly to FIG. 1, the reader will observe the location of the "callouts" for the section view depicted in FIG. 3. In FIG. 3 the reader may readily observe how electrical lift jack 74 defines the positional relationship between motor mounting plate 18 and transom bracket 12. Extension leg 86 of lift jack 74 is extended and retracted by the turning of an electric motor within motor housing 84. In the embodiment shown the electric motor turns a threaded shaft via a set of reduction gears. The extension leg 86 includes an internal female threaded component that is engaged to the threaded shaft driven by the motor. The extension leg is secured so that it moves linearly but does not rotate. As a result—when the threaded shaft is rotated by the motor—extension leg 86 is extended or retracted (depending on the direction of rotation of the threaded shaft). This type of jackscrew mechanism is well known to those skilled in the art and thus it has not been illustrated in detail.

The upper portion of electrical lift jack 74 is pivotally connected to upper bracket 22 by upper pin joint 38 (Upper bracket 22 is attached to motor mounting plate 18, such as by a welded or bolted joint). The lower portion of extension leg 86 is pivotally connected to lower bracket 40 by lower pivot pin 42. The lower bracket is attached to transom bracket 12 (such as by another welded or bolted joint).

Figure 4:
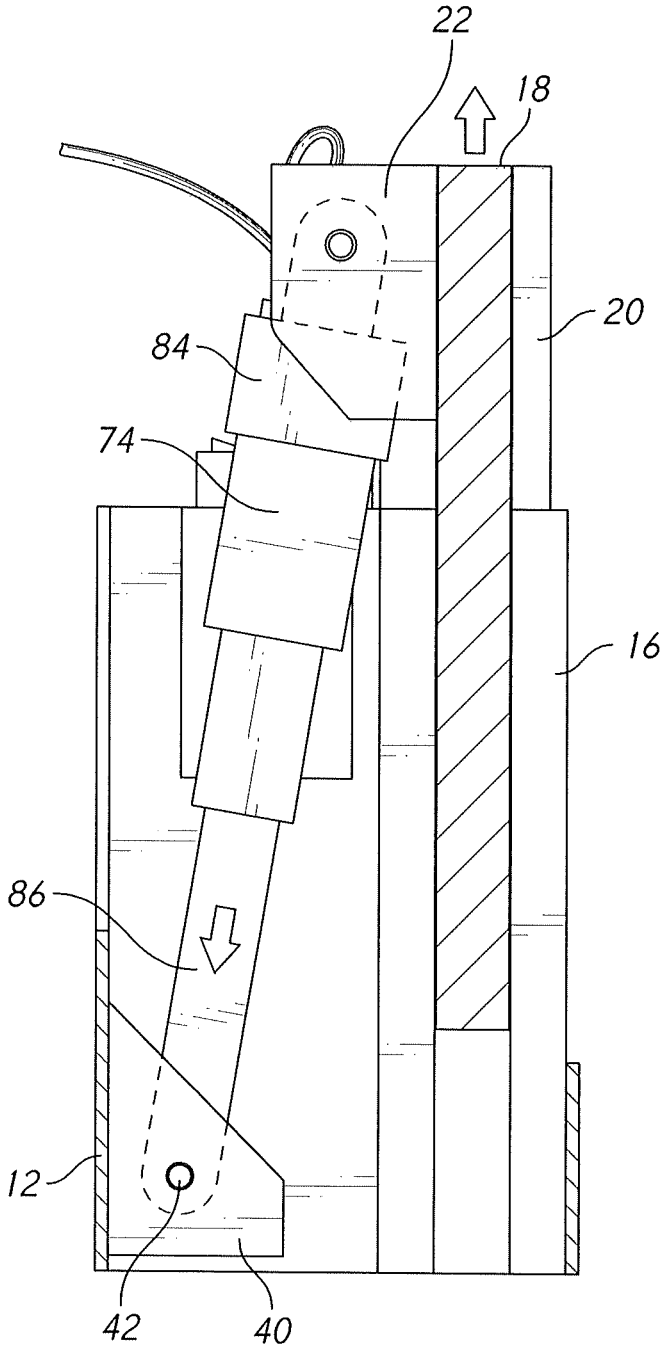
FIG. 4 is a sectional elevation view, showing the embodiment of FIG. 3 with the motor mounting plate in an elevated position.

FIG. 4 shows the same assembly as FIG. 3. However, in the depiction of FIG. 4, the electric motor within motor housing 84 has been operated to extend extension leg 86—as indicated by the arrow. The result is that motor mounting plate 18 is urged upward. By studying FIGS. 3 and 4, the reader will perceive how the extension and retraction of extension leg 86 serves to move motor mounting plate 18 up and down within the two receivers 14,16.

Returning now to FIG. 1, the reader will recall that the inventive jack plate assembly is actuated by an electric motor within electrical lift jack 74. Control of this motor is provided by a controller within controller housing 78. A handheld remote control is preferably also provided. These components are connected by both wired and wireless components.

Figure 5:
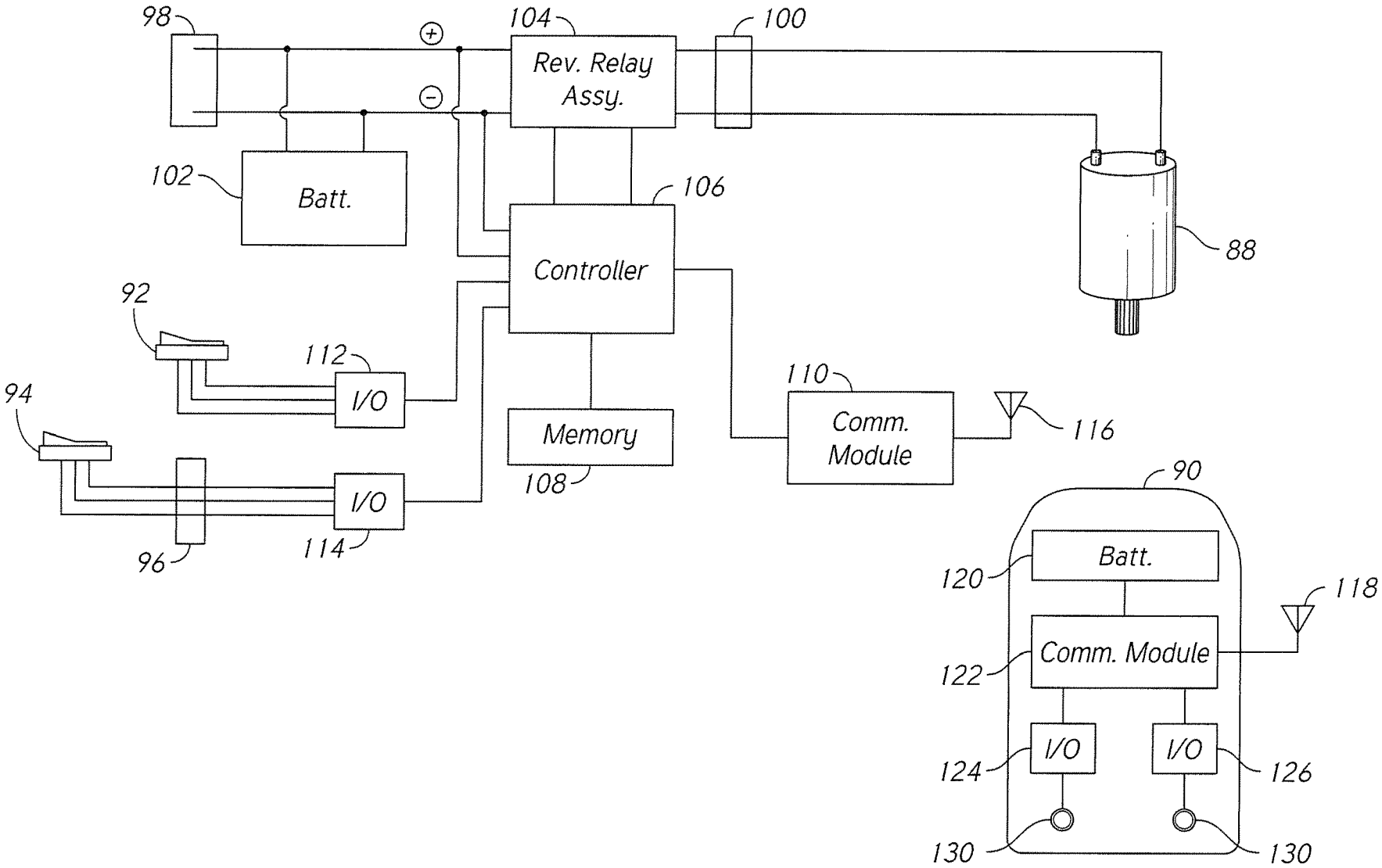
FIG. 5 is a block diagram, showing the operation of the communication and control aspects of an embodiment of the invention.

FIG. 5 depicts an exemplary block diagram—showing the control components and how they interact with the motor within the electrical lift jack 74. Battery 102 provides stored electrical energy. Motor 88 drives the electrical lift jack. In this example, the motor is a simple DC unit that can be driven in either direction by reversing the polarity of the voltage on its two input leads.

Reversing relay assembly 104 provides one of three states. These are: (1) Open circuit, in which no voltage is applied to the motor, (2) Extension mode, in which voltage of a polarity configured to drive the motor in the extension direction is applied to the motor, and (3) Retraction mode, in which voltage configured to drive the motor in the retraction direction is applied to the motor.

Controller 106 controls the operation of the reversing relay assembly. The controller is preferably a processor running software. Memory 108 (which may be on-board the processor chip or separate) stores the software to be run. Communication module 110 receives wireless signals via antenna 116. This allows the controller to respond to wireless signals sent by a remote control.

Remote control 90 is a separate hand-held unit. It is preferably contained within a weather-resistant housing. Battery 120 provides electrical energy to communication module 122. Buttons 128, 130 provide signals to communication module 122 by I/O ports 124,126 respectively. In this example, button 128 commands the raising of the jack plate (via extending the electrical lift jack) and button 130 commands the lowering of the jack plate (via retracting the electrical lift jack). Once a button push is detected, communication module 122 creates an appropriate signal and sends it via antenna 118. This signal is received by antenna 116 and sent by communication module 110 to controller 106—which then acts on the signal received.

The user can employ remote control 90 from any desired location on the boat. As an example, the user may drive the boat from a center console that is some distance away from the jack plate. While driving the boat the user can press one of the buttons 128, 130 to raise or lower the outboard motor. This can be done while the boat is moving if desired.

Remote control 90 may be made small enough to fit on a key ring. This allows the remote to be kept on the same ring as the boat keys, for example. The remote control can also be configured to slide and lock into a fixed receiver—such as a receiver that is attached proximate the boat's steering station. The remote may also be placed in a housing that is itself configured to be attached to the boat.

In more sophisticated embodiments remote control 90 can be equipped with a display indicating the current position of motor mounting plate 18. In this version the motor is provided with a pulse generator that sends a control signal to controller 106. The pulse generator is used to count revolutions from a "home" position. The home position will generally be the fully retracted position—set by the closing of a limit switch within the electrical lift jack. The controller then counts pulses to determine how far the motor has traveled away from the home position. This can be equated to a "percentage of lift" value or an outright distance value. Percentage of lift is often easier to use. The boat operator will be told that the lowest possible position for the jack plate is 0% and the highest position is 100%.

Controller 106 generates a percentage of lift signal and sends this to communication module 110 which then transmits it to remote control 90. In this scenario, the communication between controller 106 and remote control 90 is two-way. Remote control 90 can be provided with a numerical display, a collection of successively illuminated LED's, or some other method of displaying the percentage of lift.

Alternatively, controller 106 can be configured to communicate with a separate smartphone or similar device. As one example, a BLUETOOTH (managed by the Bluetooth Special Interest Group of Kirkland, Washington, U.S.A.) communication chip set could be interfaced with controller 106. This would allow a signal such as the percentage of lift to be sent to a user's smartphone (or similar device) and displayed on that device's display.

Remote control 90 is preferably provided with encryption so that the signals sent to controller 106 are limited to a particular user. Encryption can be set using DIP switches or other known devices. Alternatively, the controller 106 and the remote control 90 can be paired at the factory so that they will only communicate with each other (and possibly an authorized third party device such as a smartphone).

Figure 6:
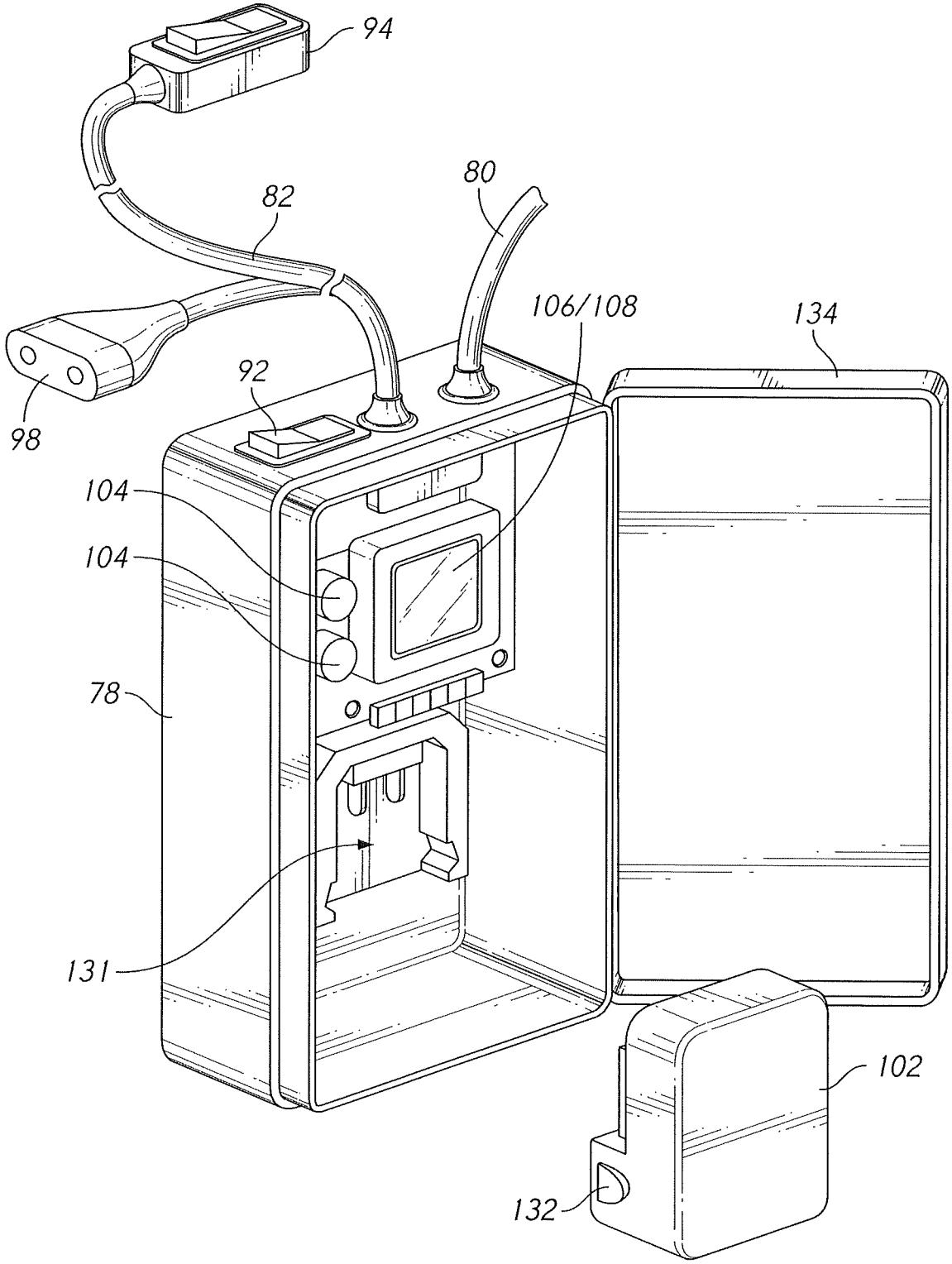
FIG. 6 is a perspective view, showing an exemplary controller housing and some internal and external components.

FIG. 6 depicts an exemplary physical embodiment for the controller housing, the controller, the battery, and some control switches. Controller housing 78 is made of a tough and water-resistant polymer. Door 134 swings closed and latches into place over the opening. A sealing gasket is provided around the perimeter of the opening so that—when the door is closed—water will not enter the unit. A positive latch is provided to hold the door in the closed position.

Inside the housing is a circuit board containing a chip socket. In this example, controller 106 and its integral memory 108 is contained in a single chip that is snapped into the chip socket on this circuit board. Reversing relay assembly 104 comprises a pair of board mounted relays or power output transistors. These are under the control of controller 106.

Battery receiver 131 is mounted to the case and wired to the circuit board. The battery receiver is preferably of the type configured to receive a high-density battery such as used on power drills and the like. For purposes of this disclosure, such a battery will be referred to as a "power tool battery." An example is a Kobalt 24V "Max Lithium Ion" battery (Model No. KB 424-03, marketed by Lowe's Companies, Inc., of North Wilkesboro, North Carolina, U.S.A.). Such batteries are designed so that a mechanical and electrical connection are simultaneously made when the battery is locked into a specially designed battery receiver. Battery receiver 131 contains electrical connections for the battery and physical connections for engaging and retaining the battery's casing. Battery 102 slides into the battery receiver and locks in place. In order to remove the battery, the user must press inward on a pair of releases 132 (A release is provided on each side of the battery but only one is visible in FIG. 6). In the orientation shown in FIG. 6, the user would slide the battery downward and then pull it away from the receiver.

Once free, battery 102 can be placed in a separate line-powered charger. Such power tool batteries are widely available, and it is common for a user to maintain two or more such batteries for each powered tool. One battery can be left on the charger. The user then swaps the battery in the unit for a freshly charged one. This is conveniently done in just a few seconds.

Connector cord 80 connects the controller housing to the electrical lift jack. This cord includes the two motor leads and—if provided—a pulse counter lead or other similar control wiring. External cord 82 is optionally provided for an external charging connector 98 and remote switch 94. The external charging connector can be used to charge battery 102 while it remains in battery receiver 131. Remote switch 94 in this example is a weather-resistant rocker switch that is used to activate the electrical lift jack in a desired direction. Housing switch 92 is also provided to activate the electrical lift jack.

These additional control devices are shown in the block diagram of FIG. 5. Housing switch 92 communicates with controller 106 through I/O port 112. Remote switch 94 communicates with controller 106 through I/O port 114. Connectors are preferably provided so that one or more of the external devices can be detached as desired. In the example shown, connectors 96, 98, and 100 are provided.

The controller housing can be mounted to the jack plate assembly as shown in the embodiment of FIG. 1. It is desirable in many embodiments, however, to mount it elsewhere. The user will open the housing from time to time in order to replace or recharge the battery. The user may therefore with to mount the housing on the transom away from the jack plate assembly. The user may also wish to mount the housing on a nearby portion of the gunwale. The user can also simply leave the housing free (unmounted). Sufficient length for the connector cord 80 can be provided to accommodate all these possibilities (and more).

The electrical lift jack is preferably one designed to operate in a marine environment. Such units are often made of stainless steel, galvanized steel, or powder-coated steel. Some units feature an aluminum chassis and extension leg, though the shafts and gears are customarily steel for these units. The other components are also preferably made for a marine environment, though this is not essential to the invention.

Additional options and features can be added and/or combined in the invention, including:

1. The DC motor described could be a different type of drive motor, such as an AC motor driven by an inverter drive;
2. A battery charge state indicator could be provided on the controller housing, the handheld remote control, or both;
3. The battery receiver could be provided outside the weather resistant controller housing;
4. The electrical lift jack could be secured to the balance of the jack plate assembly using removable pins, so that the electrical lift jack can be easily removed for cleaning and maintenance; and
5. The electrical lift jack could be an electro-hydraulic type of lift jack in which an electrical motor drives a hydraulic pump and hydraulic valves control the extension and retraction of the extension leg (which is simply the rod of a hydraulic cylinder). The control features for this version are the same as those used in the purely electrical embodiment, except that the reversing relay assembly controls solenoid-actuated hydraulic valves and the electrical motor driving the hydraulic pump is only driven in one direction. As used in this disclosure, the term "electrical lift jack" encompasses both a purely electrical version and an electro-hydraulic version.

Although the preceding description contains significant detail, it should not be construed as limiting the scope of the invention but rather as providing illustrations of the preferred embodiments of the invention. One skilled in the art may easily devise variations on the embodiments described. Thus, the scope of the invention should be fixed by the claims rather than the examples given.

Having described my invention, I claim:

1. A jack plate assembly for allowing a user to selectively adjust a height of an outboard motor relative to a transom, comprising:

(a) a transom bracket configured for attachment to said transom;

(b) a motor mounting plate, slidably connected to said transom bracket, with said motor mounting plate being configured to connect to said outboard motor;

(c) an electrical lift jack, having a first end and a second end;

(d) wherein said first end of said electrical lift jack is connected to said transom bracket and said second end of said electrical lift jack is connected to said motor mounting plate;

(e) an electrical controller configured to selectively operate said electrical lift jack in an extension mode wherein said first end of said electrical lift jack moves away from said second end of said electrical lift jack and a retraction mode wherein said first end of said electrical lift jack moves toward said second end of said electrical jack;

(f) a separate remote control configured to wirelessly communicate with said electrical controller; and (g) wherein power to said electrical lift jack is provided by a power tool battery.

2. The jack plate assembly for allowing a user to selectively adjust a height of an outboard motor relative to a transom as recited in claim 1, wherein;

(a) said first end of said electrical lift jack is connected to said transom bracket by a lower pin joint; and (b) said second end of said electrical lift jack is connected to said motor mounting plate by an upper pin joint.

3. The jack plate assembly for allowing a user to selectively adjust a height of an outboard motor relative to a transom as recited in claim 1, further comprising a battery receiver configured to releasably receive said power tool battery.

4. The jack plate assembly for allowing a user to selectively adjust a height of an outboard motor relative to a transom as recited in claim 1, wherein said controller is contained in a weather-resistant controller housing that is separate from said electrical lift jack.

5. The jack plate assembly for allowing a user to selectively adjust a height of an outboard motor relative to a transom as recited in claim 3, wherein said controller and said battery receiver are contained in a weather-resistant controller housing that is separate from said electrical lift jack.

6. The jack plate assembly for allowing a user to selectively adjust a height of an outboard motor relative to a transom as recited in claim 5, further comprising a housing switch on said controller housing, wherein said housing switch is configured to communicate with said electrical controller.

7. The jack plate assembly for allowing a user to selectively adjust a height of an outboard motor relative to a transom as recited in claim 1, wherein said remote control contains a first button that commands said extension mode and a second button that commands said retraction mode.

8. A jack plate assembly for allowing a user to selectively adjust a height of an outboard motor relative to a transom, comprising:

(a) a transom bracket configured for attachment to said transom;

(b) a motor mounting plate, slidably connected to said transom bracket, with said motor mounting plate being configured to connect to said outboard motor;

(c) an electrical lift jack, having a first end and a second end;

(d) wherein said first end of said electrical lift jack is connected to said transom bracket and said second end of said electrical lift jack is connected to said motor mounting plate;

(e) said electrical lift jack being configured to operate in an extension mode wherein said first end of said electrical lift jack moves away from said second end of said electrical lift jack and a retraction mode wherein said first end of said electrical lift jack moves toward said second end of said electrical jack; and (f) a separate remote control configured to wirelessly command the operation of said electrical lift jack; and (g) wherein power to said electrical lift jack is provided by a power tool battery.

9. The jack plate assembly for allowing a user to selectively adjust a height of an outboard motor relative to a transom as recited in claim 8, wherein:

(a) said first end of said electrical lift jack is connected to said transom bracket by a lower pin joint; and (b) said second end of said electrical lift jack is connected to said motor mounting plate by an upper pin joint.

10. The jack plate assembly for allowing a user to selectively adjust a height of an outboard motor relative to a transom as recited in claim 8, further comprising a battery receiver configured to releasably receive said power tool battery.

11. The jack plate assembly for allowing a user to selectively adjust a height of an outboard motor relative to a transom as recited in claim 8, wherein said electrical lift jack is controlled by a controller contained in a weather-resistant controller housing that is separate from said electrical lift jack.

12. The jack plate assembly for allowing a user to selectively adjust a height of an outboard motor relative to a transom as recited in claim 11, wherein said controller is contained in a weather-resistant controller housing that is separate from said electrical lift jack.

13. The jack plate assembly for allowing a user to selectively adjust a height of an outboard motor relative to a transom as recited in claim 12, further comprising a housing switch on said controller housing, wherein said housing switch is configured to communicate with said electrical controller.

14. The jack plate assembly for allowing a user to selectively adjust a height of an outboard motor relative to a transom as recited in claim 8, wherein said remote control contains a first button that commands said extension mode and a second button that commands said retraction mode.

15. A jack plate assembly for allowing a user to selectively adjust a height of an outboard motor relative to a transom, comprising:

(a) a transom bracket configured for attachment to said transom;

(b) a motor mounting plate, slidably connected to said transom bracket, with said motor mounting plate being configured to connect to said outboard motor;

(c) an electrical lift jack powered by an electric motor, having a first end and a second end;

(d) wherein said first end of said electrical lift jack is connected to said transom bracket and said second end of said electrical lift jack is connected to said motor mounting plate;

(e) an electrical controller configured to selectively operate a reversing relay assembly configured to drive said electric motor in a first direction to operate said electrical lift jack in an extension mode wherein said first end of said electrical lift jack moves away from said second end of said electrical lift jack and to drive said electric motor in a second direction to operate said electrical lift jack in a retraction mode wherein said first end of said electrical lift jack moves toward said second end of said electrical jack;

(f) a separate remote control configured to wirelessly communicate with said electrical controller; and (g) wherein power to said electrical lift jack is provided by a power tool battery.

16. The jack plate assembly for allowing a user to selectively adjust the height of an outboard motor relative to a transom as recited in claim 15, wherein:

(a) said first end of said electrical lift jack is connected to said transom bracket by a lower pin joint; and (b) said second end of said electrical lift jack is connected to said motor mounting plate by an upper pin joint.

17. The jack plate assembly for allowing a user to selectively adjust a height of an outboard motor relative to a transom as recited in claim 15, further comprising a battery receiver configured to releasably receive said power tool battery.

18. The jack plate assembly for allowing a user to selectively adjust a height of an outboard motor relative to a transom as recited in claim 15, wherein said controller is contained in a weather-resistant controller housing that is separate from said electrical lift jack.

19. The jack plate assembly for allowing a user to selectively adjust a height of an outboard motor relative to a transom as recited in claim 18, wherein said controller and said battery receiver are contained in a weather-resistant controller housing that is separate from said electrical lift jack.

20. The jack plate assembly for allowing a user to selectively adjust a height of an outboard motor relative to a transom as recited in claim 19, further comprising a housing switch on said controller housing, wherein said housing switch is configured to communicate with said electrical controller.

* * * * *